United States Patent [19]

Ariga et al.

[11] Patent Number: 4,470,590

[45] Date of Patent: Sep. 11, 1984

[54] STACKING DEVICE FOR PAPER SHEETS

[75] Inventors: Yoshio Ariga; Toshiyuki Miyano; Yukinori Wakisaka, all of Yokohama, Japan

[73] Assignee: Tokyo Shibaura Denki Kabushiki Kaisha, Kawasaki, Japan

[21] Appl. No.: 340,892

[22] Filed: Jan. 19, 1982

[30] Foreign Application Priority Data

Feb. 24, 1981 [JP] Japan ..... 56-24914[U]

[51] Int. Cl.[3] ..... B65H 29/40; B65H 31/32

[52] U.S. Cl. ..... 271/187; 271/189; 271/186; 271/218; 271/315; 271/178; 414/50

[58] Field of Search ..... 271/187, 189, 190–192, 271/186, 65, 218, 315, 178, 82; 414/50, 80, 81

[56] References Cited

U.S. PATENT DOCUMENTS

| | | | |
|---|---|---|---|
| 4,060,231 | 11/1977 | Stobb et al. | 271/187 |
| 4,139,191 | 2/1979 | Muller | 271/189 |
| 4,357,126 | 11/1982 | Kidd et al. | 271/187 |
| 4,363,584 | 12/1982 | Kokubo | 271/315 |

FOREIGN PATENT DOCUMENTS

| | | | |
|---|---|---|---|
| 1079078 | 4/1960 | Fed. Rep. of Germany . | |
| 528975 | 11/1972 | Switzerland . | |
| 424422 | 2/1935 | United Kingdom | 271/315 |
| 434503 | 9/1935 | United Kingdom . | |
| 2059391 | 4/1981 | United Kingdom . | |

*Primary Examiner*—Bruce H. Stoner, Jr.
*Assistant Examiner*—James E. Barlow
*Attorney, Agent, or Firm*—Banner, Birch, McKie & Beckett

[57] ABSTRACT

Paper currency notes, transported edgewise one by one, are discharged from a transport passage. Each discharged note is held between blades of a rotating blade wheel and moves along with the rotation of the wheel. The notes are then separated from the blades by a checking wall of a stacking box, and stacked in the stacking box. When a predetermined number of notes, for example 100, are stacked in the stacking box, a rotating sectional stacking member is rotated along with the wheel and stops in advance of the stacking box so as to separate the 100th note from the 101st. Since the rotation sectional stacking member has the same axis of rotation as the blade wheel and moves at the same speed, there is must less danger of disruption of the smooth flow of notes.

15 Claims, 12 Drawing Figures

STACKING DEVICE FOR PAPER SHEETS

BACKGROUND OF THE INVENTION

This invention relates to a stacking device for paper sheets, such as currency, in which paper sheets transported edgewise one by one are piled up vertically. In recent years, with the increased emphasis in the banking industry on labor saving devices, a currency note arranger has found practical use. This currency note arranger is designed to take out the currency notes one by one from a supply unit, to transport them, and to discriminate reusable from worn-out notes during transportation. After discrimination, both reusable (hereinafter fit) and unfit notes are automatically stacked, for example, in groups of 100 notes, in a stacking box and then bundled. In a device in which the currency notes are transported directly from the transport passage into the stacking box, during high speed, continuous operation one note may be transported before the preceding note is stacked completely. As a result, the leading edge of the succeeding note may strike the preceding note resulting in disruption of the stack.

In a conventional device to obviate the above-mentioned disadvantage, as shown in FIG. 1, currency notes P transported from transport passage A are held in a rotating blade wheel B and are guided into a stacking box C with rotation of the blade wheel B. Blade wheel B is constructed with a plurality of wheel blades E forming a fixed angle with the radius at the point of attachment. Each currency note P is held between surface of wheel cylinder D and a blade E, and these notes P are stacked in stacking box E in an orderly fashion even if they are transported from the transport passage A continuously and at high speed. A sectional stacking mechanism F provided adjacent to wheel B has a sectional stacking member G. As shown by a solid line, sectional stacking member G is positioned behind the path along which notes travel from transport passage A to wheel B. When the number of notes in stacking box E reaches, for example, 100 as detected by a note detector J, mechanism F is operated to rotate sectional stacking member G in the direction of arrow X and to stop it at the position shown by the dotted line. While a group of currency notes (i.e., 100 notes) in stacking box C is discharged into a bundling unit (not shown), sectional stacking member G stacks the succeeding currency notes. When stacking box C becomes empty, stacking member G is rotated to guide the temporarily stacked notes into the stacking box C. Development of sectional stacking mechanism F proved to be an important advance because it allowed currency notes to be stacked continuously without stopping the machine.

However, there is still a risk in these conventional stacking device that currency notes P transported at high speed will strike the sectional stacking member G before they are fully seated between the blades E, resulting in irregular stacking of the currency notes in the stacking box. The reason for this is that sectional stacking member G rotates around a different rotational axis than does blade wheel B. Consequently, portions of the path traveled by stacking member G intersect the path traveled by sheets carried on blade wheel B. Also as a result of the different rotational axes, when stacking member G rotates, there is relative motion between it and blade wheel B, increasing the chance of sheets striking stacking member G. Also notes P held between blades E may be bent by moving sectional stacking member G, stacked in a bent condition in stacking box C, and inclined in the stacking box resulting in a disorderly stack. Furthermore, since sectional stacking mechanism F and wheel B are driven by separate driving mechanisms H and I and the mechanism itself is large, the device suffers the additional disadvantages that the layout is complicated and the machine is large and cumbersome.

SUMMARY OF THE INVENTION

It is an object of the invention to overcome the prior art disadvantages mentioned above. The invention provides a stacking device for paper sheets such as currency incorporating an apparatus for interrupting a continuous flow of sheets at a fixed number and precisely when the final sheet of that number is stacked in a stacking box.

Another object of the invention is to provide a stacking device for paper sheets wherein the paper, divided into groups of a fixed number, is stacked neatly in a stacking box.

A further object of the invention is to provide a stacking device for paper sheets which can utilize an inexpensive driving mechanism and simple control methods.

In the stacking device according to the present invention, currency notes transported one by one edgewise are discharged from a transport passage. Each discharged note is held between blades of a rotating blade wheel, moves with the rotation of the wheel, strikes against a checking wall of a stacking box and is stacked in the stacking box. When a predetermined number of notes, for example 100, are stacked in the stacking box, a sectional stacking member having the same axis of rotation as the blade wheel is rotated and stops in advance of the stacking box, separating the 100th note from the 101st. The 101st and succeeding notes held by the wheel and moved with the rotation of the wheel are temporarily stacked in the sectional stacking member and kept separate from the 100 notes previously stored in the stacking box.

Since the sectional stacking member has the same axis of rotation as the blade wheel, the path traced by the sectional stacking member during rotation does not intersect that traced by the blade wheel, and there is no risk that the sectional stacking member will obstruct the movement of the paper money held between the blades of the wheel. Also, by driving both the sectional stacking member and the blade wheel with the same drive mechanism and at the same speed, there is no relative motion between the two when the sectional stacking member is rotating. This also ensures that the currency notes move without being obstructed. Therefore, the notes transported from the transport passage are held securely between the blades and stacked properly in the stacking box without running out from between the blades.

Also, since the wheel and the sectional stacking member can be driven by the same driving mechanism, simplified construction, reduced net price, and miniaturization of the device can be achieved.

In addition, providing the sectional stacking member on the shaft of the wheel through a clutch mechanism and rotating it at the same speed as the wheel facilitates driving and controlling the sectional stacking member.

Other objects and features of the present invention will be apparent from the following description taken in connection with the accompanying drawings.

BRIEF DESCRIPTION OF THE DRAWINGS

FIG. 4(*b*) is a side view of the sectional stacking mechanism shown in FIG. 4(*a*).

DETAILED DESCRIPTION OF THE INVENTION

Figure 1:
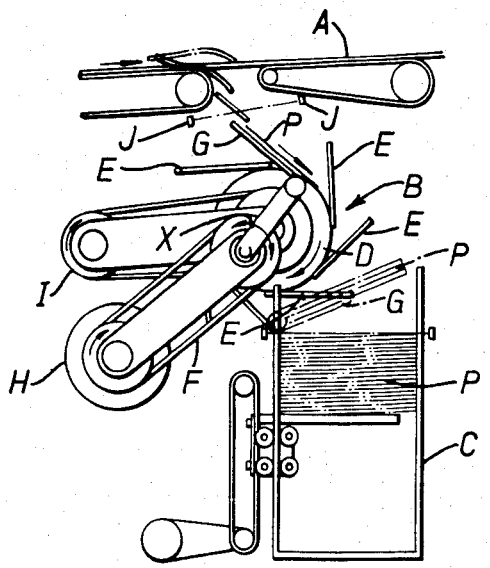
FIG. 1. PRIOR ART
FIG. 1 is an elevational view showing a conventional stacking device for paper money.
Figure 2:
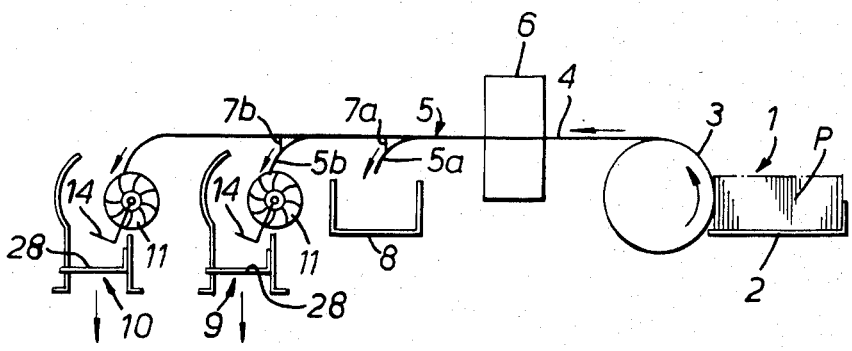
FIG. 2 is a diagram of a currency note arranger with a paper money stacking device which is an embodiment of the present invention.
Figure 3:
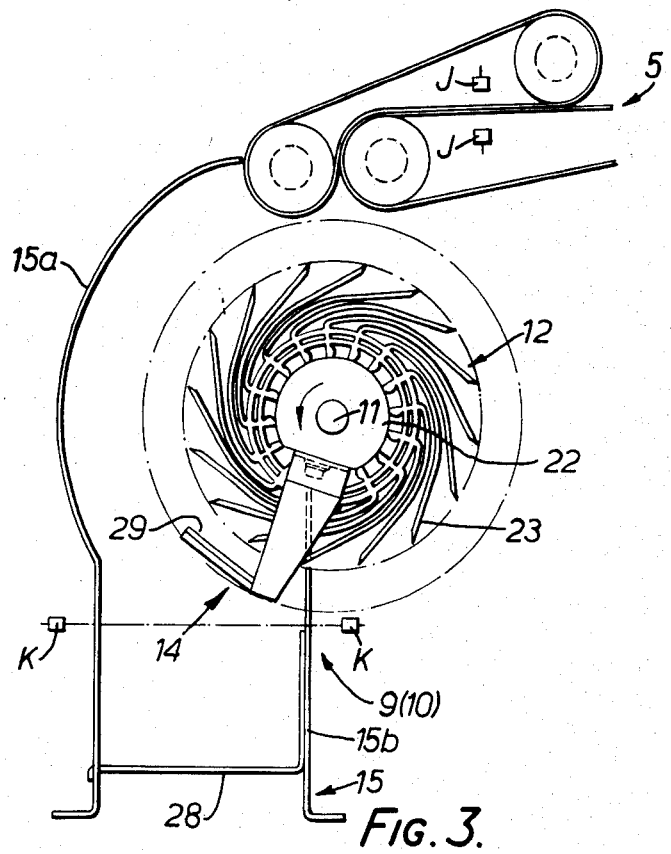
FIG. 3 is an elevational view of the paper money stacking device shown in FIG. 2.
Figure 4:
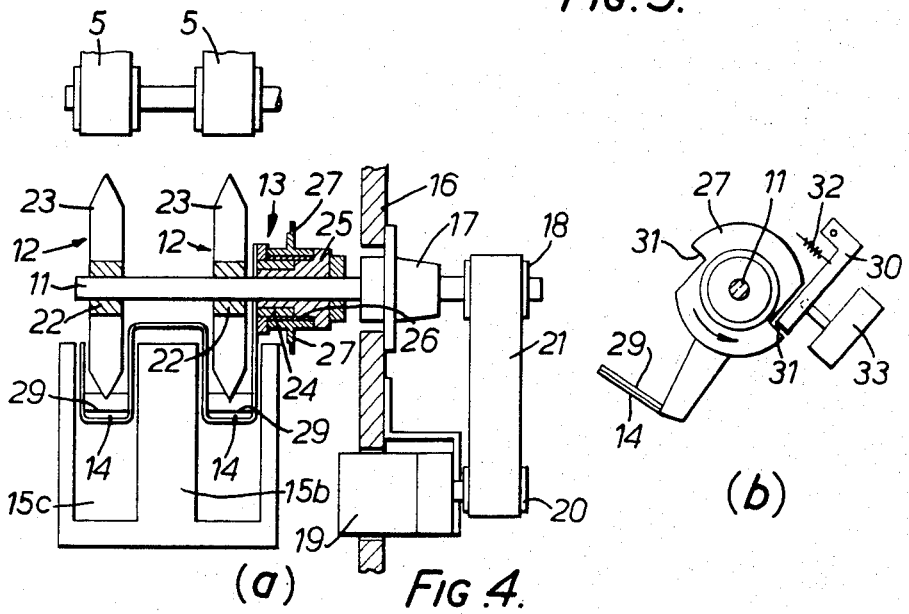
FIG. 4(*a*) is a partial sectional view of the paper money stacking device shown in FIG. 3.

As shown in FIG. 2, in supply unit 1 currency notes P are stored vertically in a supply box 2 and supplied one by one with rotation of rotor 3. Currency note P taken out from supply unit 1 is transported by transporting belt 4 which constitutes a transport passage 5 for transporting currency notes P at the speed of 1.6 m/sec. On transport passage 5, currency note P is read by a discriminating unit 6 for discriminating fit notes from unfit ones. An electric signal from discriminating unit 6 controls a first gate 7*a* and a second gate 7*b*. First stacking unit 8 is positioned facing a branch 5*a* of first gate 7*a* for stacking currency notes which could not be discriminated by discriminating unit 6 such as skewed, overlapped, and counterfeit notes. Second stacking unit 9 is positioned facing a branch 5*b* of second gate 7*b*, for stacking fit notes. Third stacking unit 10 is positioned facing the end of transport passage 5, for stacking unfit notes such as dirty, partially torn, and taped notes. First stacking unit 8 is a mere casing, but second and third stacking units 9 and 10 are constructed to be identical. Each unit is constructed as shown in FIGS. 3 and 4 and comprises a blade wheel 12 coupled on a shaft 11, a sectional stacking member 14 attached to shaft 11 by a clutch mechanism 13, and a stacking box 15.

Shaft 11, rotating twice a second, is supported by a shaft bearing 17 mounted on a support plate 16; the end of the shaft includes a following pulley 18. On support plate 16 is also mounted a driving motor 19. A belt 21 connects a driving pulley 20 attached to a shaft of motor 19 and following pulley 18, for transmitting rotational energy from motor 19 to shaft 11. Blade wheel 12 comprises a ring-shaped wheel 22 and blades projected from its peripheral surface. These blades 23 are formed spirally, with the interval between the tips widened and that between the roots narrowed. Each blade 23 is rotated so that the blade tip moves at a speed of 0.65 m/sec.

Clutch mechanism 13 is, for example, a conventional spring clutch and comprises an input hub 25 attached to shaft 11, an output hub 24 attached to sectional stacking member 14, a coil spring 26 wound on a part of the peripheral surfaces of both input hub 25 and output hub 24, and a stopper 27 engaging with coil spring 26. As shown in FIG. 4(*b*), stopper 27 has two notches 31 provided at intervals of substantially 180°. A lever 30 is held in contact with the surface of stopper 27 by a tension spring 32. An electromagnet 33 is provided for attracting lever 30 away from the surface of stopper 27. When lever 30 is inserted into notch 31 of stopper 27, stopper 27 stops the rotation of output hub 24. And when lever 30 is disengaged from notch 31 of stopper 27, stopper 27 allows coil spring 26 to tighten, transmitting the rotational energy from input hub 25 to output hub 24. Sectional stacking member 14 extends radially beyond the ends of blades 23; and on its surface is a stop plate 29 made of a material such as rubber which has a high coefficient of friction with paper. The purpose of a rubber stop plate 29 is to prevent paper sheets stacked on sectional stacking member 14 from slipping. Stacking box 15 comprises one side wall 15*a* which is bent to form a guide surface, and another side wall 15*b*, serving as a stationary checking wall, which has notches 15*c* large enough so that blade 23 and sectional stacking member 14 can pass through but small enough that stationary checking wall 15*b* interrupts or checks currency notes P. Stacking box 15 further comprises a receiving plate 28 which can be moved upwards and downwards.

The height of the uppermost currency note P stacked on receiving plate 28 is kept constant by adjusting the height of receiving plate 28 upwards and downwards in accordance with a signal from photoelectric detector K—K. Also, receiving plate 28 in stacking box 15 is moved downwards to take out the stacked currency notes.

Figure 5:
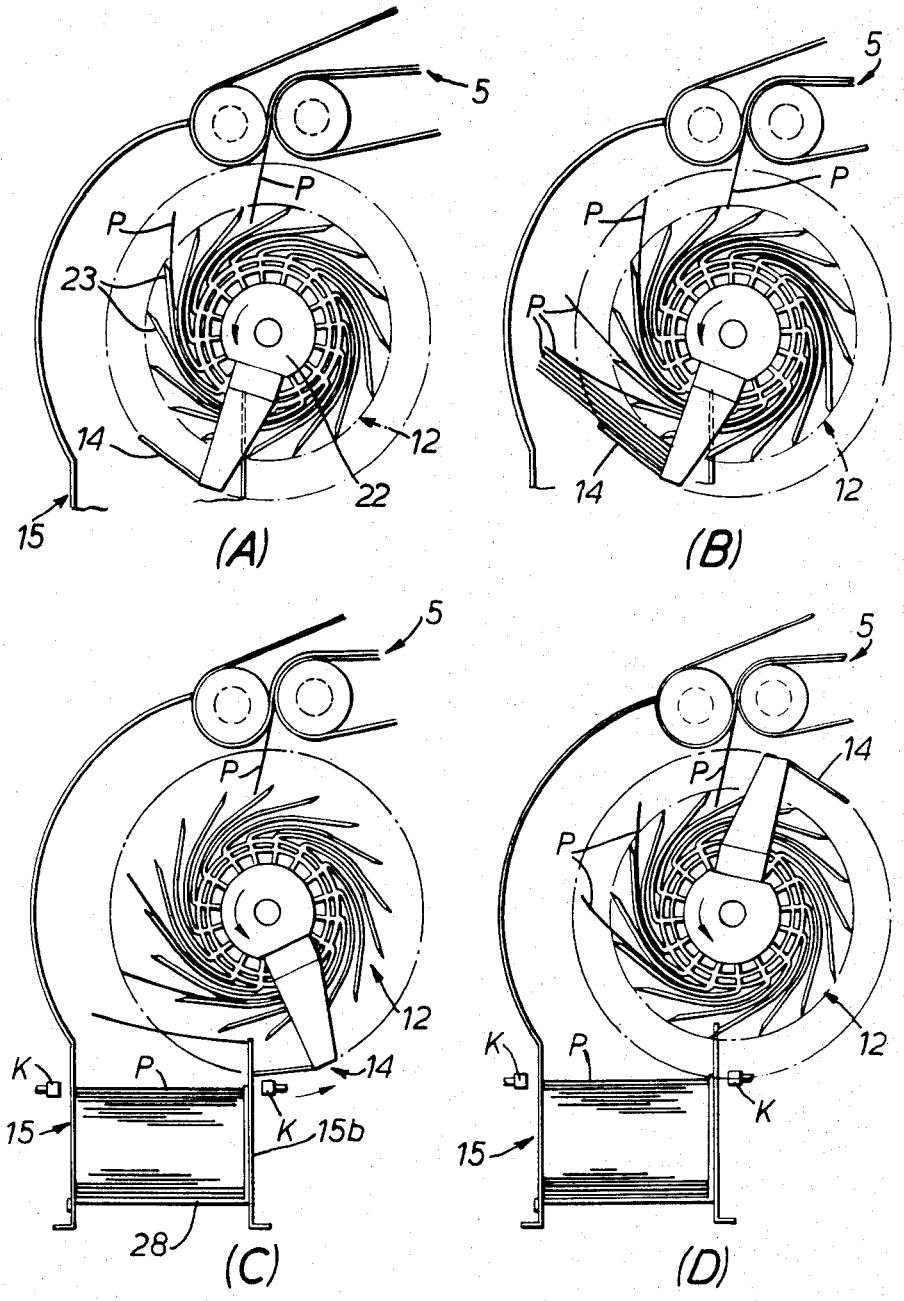
FIGS. 5(A) to (F) are elevation views showing a succession of steps in the stacking of paper money in the paper money stacking device shown in FIG. 3.
Figure 5:
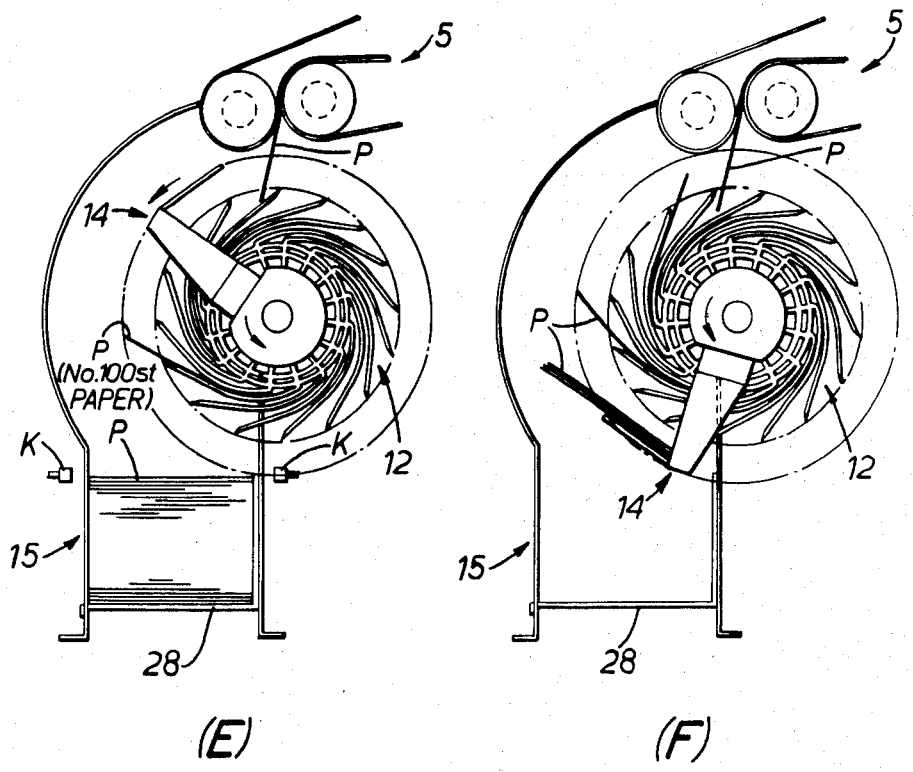

As shown in FIGS. 3 and 5(A), currency notes P transported successively on transport passage 5 are transported toward blade wheel 12 rotating in the direction of the arrow. The arrival of currency notes P is detected at a photoelectric detecting unit J—J, a conventional photoelectric detector connected to a conventional counting mechanism. (In this case, blade wheel 12 is rotated at approximately one-half of the transporting speed on transport passage 5.) Clutch mechanism 13 is disengaged at this time, and sectional stacking member 14 is stopped at a position in advance of stacking box 15 and stationary checking wall 15*b*. That is, lever 30 is inserted into one notch 31 of stopper 27 to prevent rotation of stopper 27, and spring 26 is relaxed, disconnecting input hub 25 from output hub 24 shown in FIG. 4(*a*). Currency notes P are inserted between blades 23 of blade wheel 12 and are carried as held between the blades 23. As shown in FIG. 5(B), currency notes P are transported with the rotation of wheel 12 and are deposited on sectional stacking member 14. When the arrival of, for example, the 60th note is detected by photoelectric detecting unit J—J at the discharge end of transport passage 5, electromagnet 33 is energized, removing lever 30 from notch 31 of stopper 27 and releasing stopper 27. Spring 21 then tightens, imparting the rotational force of input hub 25 to output hub 24; in other words, clutch mechanism 13 becomes engaged, and the rotating force of shaft 11 is given to sectional stacking member 14. As a result, as shown in FIG. 5(C), sectional stacking member 14 is rotated at the same speed as wheel 12. Although sectional stacking member 14 is small enough to pass through notch 15*c* of stationary checking wall 15*b*, stacked currency note group P on sectional stacking member 14 is not; it strikes stationary checking wall 15*b* and then drops onto receiving plate 28. Currency notes P thereafter transported successively by blade wheel 12 are stacked directly on the currency note group P on receiving plate 28, without interim storage on stacking member 14. As shown in FIG. 5(D), when sectional stacking member 14 reaches a position just in advance of the discharge end of transport passage 5, a position in which it cannot contact currency notes carried on rotating blade wheel 12, stopper 27 strikes lever 30 (electromagnet 33 having previously been deenergized), spring 26 is relaxed, input hub 25 is disconnected from output hub 24, and no rotational force is given to output hub 25. Clutch mechanism 13 therefore becomes disengaged and sectional stacking member 14 stops rotating. Blade wheel 12 continues to rotate to guide the succeeding currency notes P into stacking box 15. Sectional stacking member 14 remains as it is until the arrival of the final currency note P in the group, for example, the 100th note, transported through the discharge end of transport passage 5, is detected by photoelectric detecting unit J—J. As shown in FIG. 5(E), when the arrival of the 100th currency note P is detected, electromagnet 33 is immediately energized to separate lever 30 from stopper 27, spring 26 of clutch 13 is tightened, input hub 25 and output hub 24 are connected by spring 26, and the rotational force of input hub 24 is given to output hub 25. Clutch mechanism 13 becomes engaged and sectional stacking member 14 is rotated. Before the 101st currency note P is transported from transport passage 5, sectional stacking member 14 passes the discharge end of transport passage 5. As shown in FIG. 5(F), when sectional stacking member 14 reaches the original position, stopper 27 strikes lever 30 (electromagnet 33 having previously been deenergized), clutch 13 is disengaged, and sectional stacking member 14 stops moving. Currency notes P up to and including the 100th note are guided to stacking box 15, and currency notes P after the 100th note are stacked on sectional stacking member 14. When the arrival of a currency note P, for example the 105th note, is detected by photoelectric detector J—J, a takeout mechanism (shown in FIG. 6) is operated to take out the 100-currency-note group I on receiving plate 28 and send it to a bundling unit (not shown).

Figure 6:
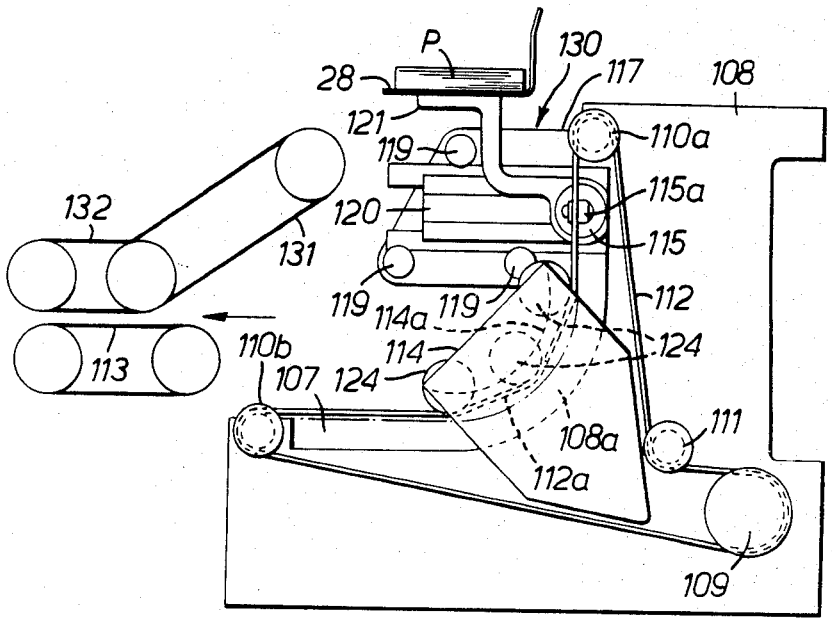
FIG. 6 is an elevation view showing a takeout mechanism for removing notes stacked on the receiving plate of the paper money stacking device which is shown in FIG. 3.

Referring to FIG. 6, when driving pulley 109 is rotated counterclockwise, it drives a belt 112 which lowers sliding roller 115 from near a sub-driving pulley 110*a*. A sliding rod 120 and a guide elevator 117 are also lowered by means of sliding roller 115. As sliding roller 115 rounds corner 112*a*, its vertical motion is changed to horizontal motion, as shown by the arrow. As a result, sliding rod 120 is moved horizontally between small rollers 119. When sliding roller 115 reaches sub-driving pulley 110*b*, an inclined belt 131 and a horzontal belt 133 remove the 100-note group from receiving plate 28. After that, the currency notes P are held between upper belt 132 and lower belt 133 and are transported to a bundling device (not shown). When belt 112 runs in the reverse direction, guide elevator 117 and sliding rod 120 are moved in the opposite direction and return to their original positions. Stacking box 15 is then empty, and sectional stacking member 14 returns to the initial state shown in FIG. 5(A). The cycle as mentioned above is then repeated.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention.

We claim:

1. A stacking device for stacking sheets of paper transported one by one along a transport passage comprising:

(a) discharge means for discharging the sheets of paper from said transport passage;

(b) rotating blade wheel means adjacent said discharge means for contacting the sheets of paper and transferring the sheets away from said discharge means, said rotating blade wheel means including a plurality of blades on the periphery of said blade wheel means for holding each sheet of paper during rotation;

(c) stationary checking means adjacent said rotating blade wheel means for removing the sheets of paper from said blades;

(d) a stacking box positioned to receive the sheets of paper removed by said stationary checking means; and (e) rotating sectional stacking means having an axis of rotation collinear with that of said rotating blade wheel means for rotating in the same direction as said rotating blade wheel means and stopping at a predetermined position in advance of said stationary checking means to remove and temporarily store sheets of paper from said rotating blade wheel means.

2. A stacking device as claimed in claim 1 wherein, when said stacking box has received a predetermined number of sheets, said rotating sectional stacking means rotates to said predetermined position, removes and temporarily stores sheets of paper from said rotating blade wheel means to permit the emptying of said stacking box.

3. A stacking device as claimed in claim 1, wherein said rotating sectional stacking means further rotates to a second position in advance of the discharge end of said transport passage to avoid contacting the sheets of paper.

4. A stacking device as claimed in claim 3 further comprising detecting means for detecting and counting sheets which are discharged from said transport passage, said detecting means further controlling the rotation of said rotating sectional stacking means in accordance with the counted number of sheets so that said rotating sectional stacking means rotates from said second position to said predetermined position when the number of sheets corresponds to a predetermined number.

5. A stacking device as claimed in claim 1 further comprising:

(a) a shaft passing through the center of said rotating blade wheel means to impart rotational motion to said rotating blade wheel means; and (b) clutch means connected to said rotating sectional stacking means for disengagably supporting said rotating sectional stacking means on said shaft.

6. A stacking device as claimed in claim 1 or claim 5 wherein said rotating sectional stacking means rotates at substantially the same rotational velocity as said rotating blade wheel means.

7. A stacking device as claimed in claim 1 wherein said rotating sectional stacking means includes a stop plate upon which sheets are temporarily stored, said stop plate comprising material which has a high coeeficient of friction with respect to paper.

8. A stacking device for stacking sheets of paper transported one by one along a transport passage comprising:

(a) discharge means for discharging the sheets of paper from said transport passage;

(b) rotating blade wheel means adjacent said discharge means for contacting the sheets of paper and transferring the sheets away from said discharge means, said rotating blade wheel means including a plurality of holding means on the periphery of said blade wheel means for holding each sheet of paper therebetween during rotation;

(c) stationary checking means adjacent said rotating blade wheel means for removing the sheets of paper from said holding means;

(d) receiving means positioned to receive the sheets of paper removed by said stationary checking means; and (e) rotating sectional stacking means having an axis of rotation collinear with that of said rotating blade wheel means for rotating in the same direction as said rotating blade wheel means and stopping at a predetermined position outside the periphery of said rotating blade wheel means to remove and temporarily store sheets of paper from said rotating blade wheel means.

9. A stacking device as claimed in claim 8 wherein, when said receiving means has received a predetermined number of sheets, said rotating sectional stacking means rotates to said predetermined position, removes and temporarily stores sheets of paper from said rotating blade wheel means to permit the emptying of said receiving means.

10. A stacking device as claimed in claim 8 wherein said rotating sectional stacking means further rotates to a second position in advance of the discharge end of said transport passage to avoid contacting the sheets of paper.

11. A stacking device as claimed in claim 10 further comprising detecting means for detecting and counting sheets which are discharged from said transport passage, said detecting means further controlling the rotation of said rotating sectional stacking means in accordance with the counted number of sheets so that said rotating sectional stacking means rotates from said second position to said predetermined position when the number of sheets corresponds to a predetermined number.

12. A stacking device as claimed in claim 8 further comprising:

(a) a shaft passing through the center of said rotating blade wheel means to impart rotational motion to said rotating blade wheel means; and (b) clutch means connected to said rotating sectional stacking means for disengagably supporting said rotating sectional stacking means on said shaft.

13. A stacking device as claimed in claim 8 wherein said rotating sectional stacking means rotates at substantially the same rotational velocity as said rotating blade wheel means.

14. A stacking device as claimed in claim 12 wherein said rotating sectional stacking means rotates at substantially the same rotational velocity as said rotating blade wheel means.

15. A stacking device as claimed in claim 8 wherein said rotating sectional stacking means includes a stop plate upon which sheets are temporarily stored, said stop plate comprising material which has a high coefficient of friction with respect to paper.

* * * * *